US007493067B2

(12) United States Patent
Wegman

(10) Patent No.: US 7,493,067 B2
(45) Date of Patent: Feb. 17, 2009

(54) TONER AND DEVELOPER PURIFICATION SYSTEM

(75) Inventor: Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 328 days.

(21) Appl. No.: 11/634,426

(22) Filed: Dec. 6, 2006

(65) Prior Publication Data

US 2008/0138117 A1 Jun. 12, 2008

(51) Int. Cl.
*G03G 15/08* (2006.01)

(52) U.S. Cl. ..... 399/253; 399/29

(58) Field of Classification Search ..... 399/29, 399/109, 252, 253; 430/118.5
See application file for complete search history.

(56) References Cited

U.S. PATENT DOCUMENTS 5,442,427 A * 8/1995 Day ..... 399/237
5,477,307 A * 12/1995 Bergen et al. ..... 399/260

* cited by examiner

*Primary Examiner*—Hoang Ngo
(74) *Attorney, Agent, or Firm*—James J. Ralabate

(57) ABSTRACT

This is a test procedure for detecting contaminants or a method for removing contaminants from toner to be used in an electrophotographic marking system. The method simulates the mixing and separation of contaminants that occur in an actual development system. It has been determined that contaminants in toner have tribo properties that prevent strong adherence of these contaminants to the carrier whereas purified toner has tribo properties that permit stronger adherence to the carrier. A separation procedure and method is thereby used to remove or identify contaminants.

20 Claims, 3 Drawing Sheets

TONER AND DEVELOPER PURIFICATION SYSTEM

CROSS REFERENCE

Illustrated and disclosed in co-pending application which is owned by the present assignee is patent application Ser. No. 11/634,425 which with the present are applications relating to toner purification in an electrostatic process. The application based on patent application Ser. No. 11/634,425 and the present application are filed concurrently herewith. The disclosures of these two applications are totally incorporated into each other herein by reference.

In patent application Ser. No. 11/634,425 concurrently filed herewith, a purification apparatus and system for use in electrostatic marking systems is disclosed and claimed. In patent application Ser. No. 11/634,425 a purification station located prior to or the same as the developer station is disclosed and claimed.

In the present patent application Ser. No. 11/634,425 a method for purifying developer prior to introduction into an electrostatic marking apparatus is disclosed and claimed.

FIELD

This invention relates to marking systems and, more specifically, to a method and system for removing contaminants from toner and developers used in said marking systems.

BACKGROUND

In the process of electrostatographic reproduction, a light image of an original to be copied or printed is typically recorded in the form of a latent electrostatic image upon a photosensitive member with a subsequent rendering of the latent image visible by the application of electroscopic marking particles commonly referred to as toner. The visual toner image can be either fixed directly upon the photosensitive member or transferred from the member to another support medium such as a sheet of plain paper. To render this toner image permanent, the image must be "fixed" or "fused" to the paper, generally by the application of heat and pressure.

With the advent of high speed monochrome and color marking machines, including xerography reproduction machines wherein copiers or printers can produce at a rate in excess of three thousand copies per hour, the need for improved developer performance is evident and useful.

A common goal in the design and development of electrostatographic marking devices is the ability to maintain optimum image quality from page to page and job to job regardless of the characteristics of the images being formed on each page. As should be appreciated, to maintain optimum image quality, it is important that the printing device sustain good quality developer, good development as well as good transfer efficiency. Good development or good developability refers to the ability of the device to transfer the appropriate amount of high quality toner to the latent image when forming the toner powder image.

It is known that maintaining the state of the material in the developer housing within an optimum purity range improves developability and transfer efficiency. To accomplish this, many marking systems use a variety of processes to maintain the state of the developer materials within the optimum range by monitoring and controlling one or more characteristics of the materials including, for example, temperature, humidity, charge, toner concentration (ratio of toner to carrier), toner purity and toner charge distribution.

However, even if the developer materials are maintained in an optimal state, it has been observed that under certain conditions such as extended running of prints with lower toner area coverage in one or more of the color separations, the developability and/or transfer efficiency can degrade and become contaminated due to changes in the material's state in the developer housing. Foreign particles in the toner and degradation in developability and/or transfer efficiency produces weak, mottled and/or streaky images.

The analytical test that measures the amount of foreign particles and coarse toner particles in a sample of toner has been standard for many years. This test is important because the analysis links the quality of the toner to the type of print defect. This was the necessary and sufficient test that provided feedback to toner manufacturing operations to verify that quality toner is being produced. More recently, however, there has been a print defect identified that is caused by agglomerated toner or additive powder. A gentle screening process was developed that is able to isolate these soft agglomerated toner particles. Unfortunately, quality problems with toners cannot be captured by this test because these new type of soft agglomerated toner particles are too friable. The particles break up with the required mechanical screening and brushing such that there are little if any retains remaining. If low levels of vacuum are used to pull material away from the screen, then even fewer retains or contamination particles can be expected resulting in a misleading analytical test result. The consensus of studying the problem is that the current analytical test is not able to segregate the soft agglomerates that are causing the print defect problem. Despite adjustments with different combinations of sample sizes, vibration, screen sizes, vacuum and brushing, these particles cannot be reliably removed and captured. So, without a reliable analytical test method, it is a great risk to begin toner-manufacturing production.

In electrostatic development processes, a developer material is used comprising relatively large magnetic carrier beads that have fine toner particles electrostatically attracted to and coated thereon. Various known means are used to convey these toner particles to the latent electrostatic image on the photoconductive surface. The composition of the carrier particles is so chosen as to electrostatically attract and hold the toner particles for transfer to the latent image preferably without contaminants. As the developer is directly or indirectly contacted into this photoconductor surface, the toner particles are electrostatically deposited and secured to the charged portion of this latent image and not deposited on the uncharged or background portion of the image. The carrier and excess toner are then recycled for later use but eventually, after extended use, become contaminated and ready to be removed from the system to be replenished with new toner and carrier. A system to extend developer life and purify the toner would be extremely economically attractive.

In magnetic brush development, bad particles, impurities, contaminants or agglomerates in the toner will separate out during development and cause dots or spots on the paper or receiving member thereby ruining the final copy. These agglomerates or impurities do not attach to the carrier because they are either or both too large in size or they do not possess a strong enough opposite tribo charge to the carrier charge. Using this knowledge, a purification process of the present invention can work in a similar fashion simulating this development process.

SUMMARY

The present embodiments provide a test procedure and also a method of removing agglomerates and impurities, hereinafter "contaminants" from toner before it is put into the marking or copy machine. The toner containing these contaminants is mixed with magnetic carrier to form a homogenous developer mixture. After some agitation, a magnet is put in or near magnetic contact with this mixture thereby drawing off the more attracted purified developer and leaving remaining the less attracted contaminants including impurities and agglomerates. The purified developer mix is then easily separated from the impurities by any suitable means and the impurities discarded. In this manner, toner contaminants, when the developer is finally used in the marking system, never contact the photoconductor to cause marks on the final copy.

When this method is used as a test procedure, the purification process was successfully carried out in one embodiment using a magnetic developer roller similar to that used in a copier. Also used in a second separate procedure was a simple test two cup arrangement where a cup holding the developer mixture was agitated to form a homogeneous developer mixture, a magnet, in the second cup, was passed over this mixture drawing out the purified developer and leaving in the cup the less attracted agglomerates or other contaminants which are then discarded. Rather than a two cup arrangement used, only one cup may be used and a magnet is attached to the outer bottom of the cup after the developer mixture was agitated to form a homogeneous developer mixture. The cup may then be inverted to separate the contaminants or the impurities are removed by any other suitable way. A third test method uses a known magnetic stirrer for liquids where, after stirring the mixture, the less magnetically attractable agglomerates are dispersed in the mixture separated from the magnetic carrier. Then the impurities are removed by any suitable way and the mixture is ready to be used in the copier or marking apparatus. This test can also be used prior to setting up manufacturing of toner.

In embodiments of this invention, whether used as a test procedure or as a method for removing contaminant, a novel process is used for detecting and/or removing contaminants including the type of very soft toner agglomerates that cause the print defects. As noted above, the embodiments use fixed amounts of magnetic carrier that is mixed with fixed amounts of the test toner material to form thereby a homogeneous developer mix. This process and system functions generally by attracting and holding to the carrier the correct size and charged toner particles similarly to the process that occurs in the actual development housing of an electrostatic marking system. The problematic larger particles, be they soft agglomerated toner or additive, coarse particles or foreign particles, are not able to be triboelectrically captured by the carrier and thus "float" in the mixture. When the mixture is gently agitated or vibrated in the horizontal direction, it is believed that the toner-covered carrier particles settle and most of the freed "bad" material (contaminants) rises to the top surface. An inspection and analysis of the "bad" material can then proceed including visual inspection. This test is an accurate simulation of the mixing that occurs in an actual development system. It accurately separates the exact type of bad contaminant particles that are the cause of print defects. There is little degradation of the particles such as occurs in any previous toner particle purification tests using vibratory sieving equipment. The inventive procedure disclosed herewith is simple and reliable.

The problematic contaminant particles or impurities, be they soft agglomerated toner or additive impurities or coarse particles or foreign particles are not able to be electrically attracted by the carrier but are captured by the magnetic brush action of the magnetic roller or other magnet. As earlier noted, It is believed that the reason these impurities are not able to be attracted by the magnetic carrier is because of either or both of these factors: (a) a weak charge of these impurities or (b) because they are too large in dimensions for the carrier to hold.

Sometimes, these toner impurities have non-uniform charges and are attracted to each other to form larger agglomerates which further cause serious print defects. Generally, any toner contaminants or impurities exceeding 30 ppm of toner are unacceptable for proper print quality. These impurities show up as black spots in monochrome systems and as different color spots (than background) in color systems.

Any suitable purification system to isolate and remove these impurities within the scope of the present embodiments may be used. In one embodiment the following steps are followed: (1) the test toner containing these contaminants is mixed with the magnetic carrier to form a substantially homogeneous mixture, (2) this mixture is placed in a substantially flat container and the mixture gently tumbled; magnetic mixing is one form that works well, (3) this mixing process includes agitation in the horizontal direction so that the impurities and contaminant particles appear, (4) the impurities or contaminants are then removed by any convenient way such as tape removal; they may be analyzed or discarded and (5) the carrier-toner mixture free from these impurities is then ready for use in an electrostatic marking system or when the method is used as a test; the information on the type or other contaminant data may be used prior to setting up toner manufacturing. This purification system and testing procedure is more specifically defined in the claims.

To confirm the viability of the present invention, several tests were conducted including those as illustrated in the accompanying figures of the drawings.

This method of purifying toner and testing procedures can be conducted manually or automated. Also, the agitating and separating can be carried out using a magnetic stirring device, or other suitable mixing means.

DETAILED DESCRIPTION OF DRAWINGS AND PREFERRED EMBODIMENTS

Figure 1:
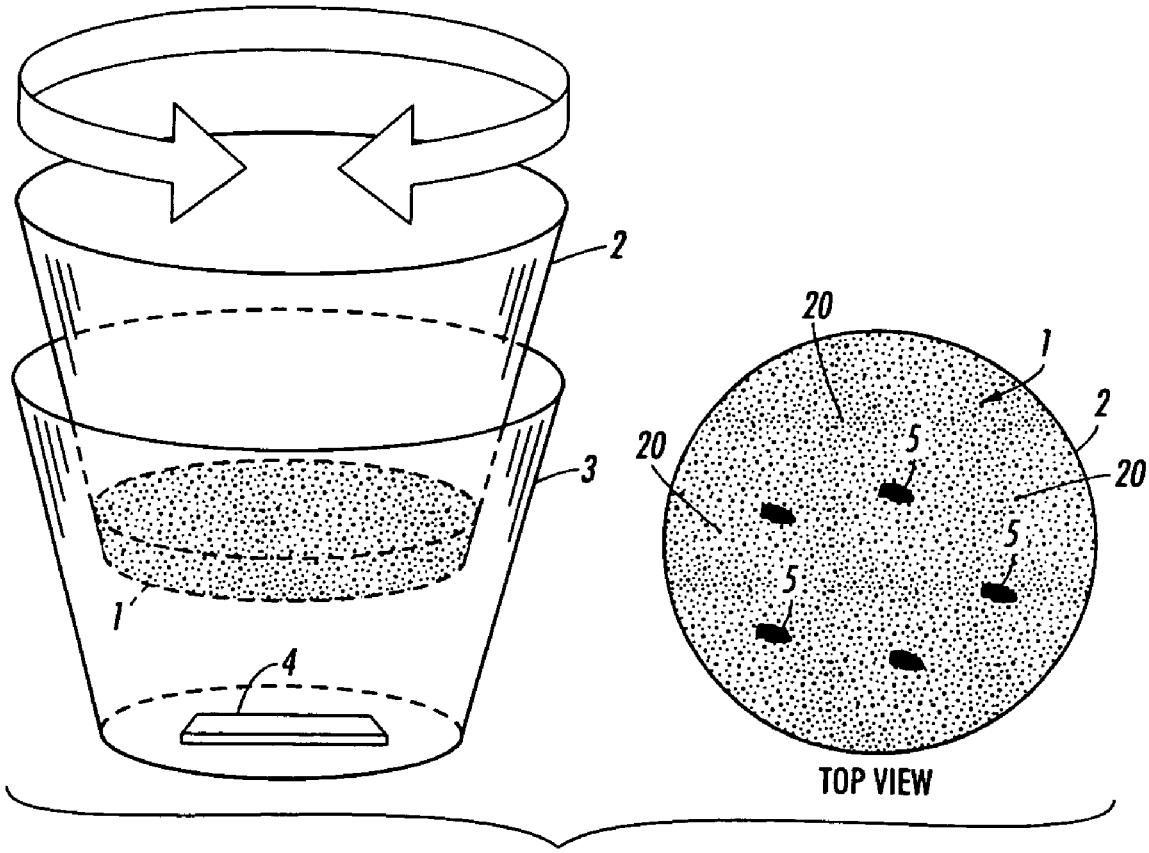
FIG. 1 illustrates a test method involving manually mixing a test developer sample in cuplike containers.

In FIG. 1, a side and a top view of the testing equipment is shown. A toner and magnetic carrier mixture 1 containing impurities 5 is deposited in inner cup 2 and mixed until a homogeneous mixture 1 is obtained. The mixture 1 is gently tumbled and mixed until the agglomerates or impurities rise to the top of the mixture 1. The cup 2 is then placed into cup 3 and a magnet 4 placed in the bottom of cup 3 thereby magnetically attracting the developer but not the contaminants 5. As the cups 2 and 3 are swirled, a magnetic brush action is accomplished. The impurities 5 are easily removed by separating cup 2 and cup 3 with the magnet 4 and the purified mixture attached and turning cup 2 upside-down to allow the contaminants or agglomerates or impurities 5 to fall out. The purified mixture 11 is then removed from cup 3 and is ready for use in an electrostatic marking system. Rather than, as illustrated, a magnet 4 being placed in cup 3, it can be attached or placed at the outside bottom of cup 2 to accomplish the same result. The impurities 5 are easily removed by tape or using a small spoon or by turning the assembly upside-down to allow the contaminants or agglomerates or impurities 5 to fall out. The purified mixture 11 is then removed from cup 2 and is ready for use in an electrostatic marking system. The top view in FIG. 1 shows the larger impurity particles 5 and the smaller purified developer particles 20.

Figure 2:
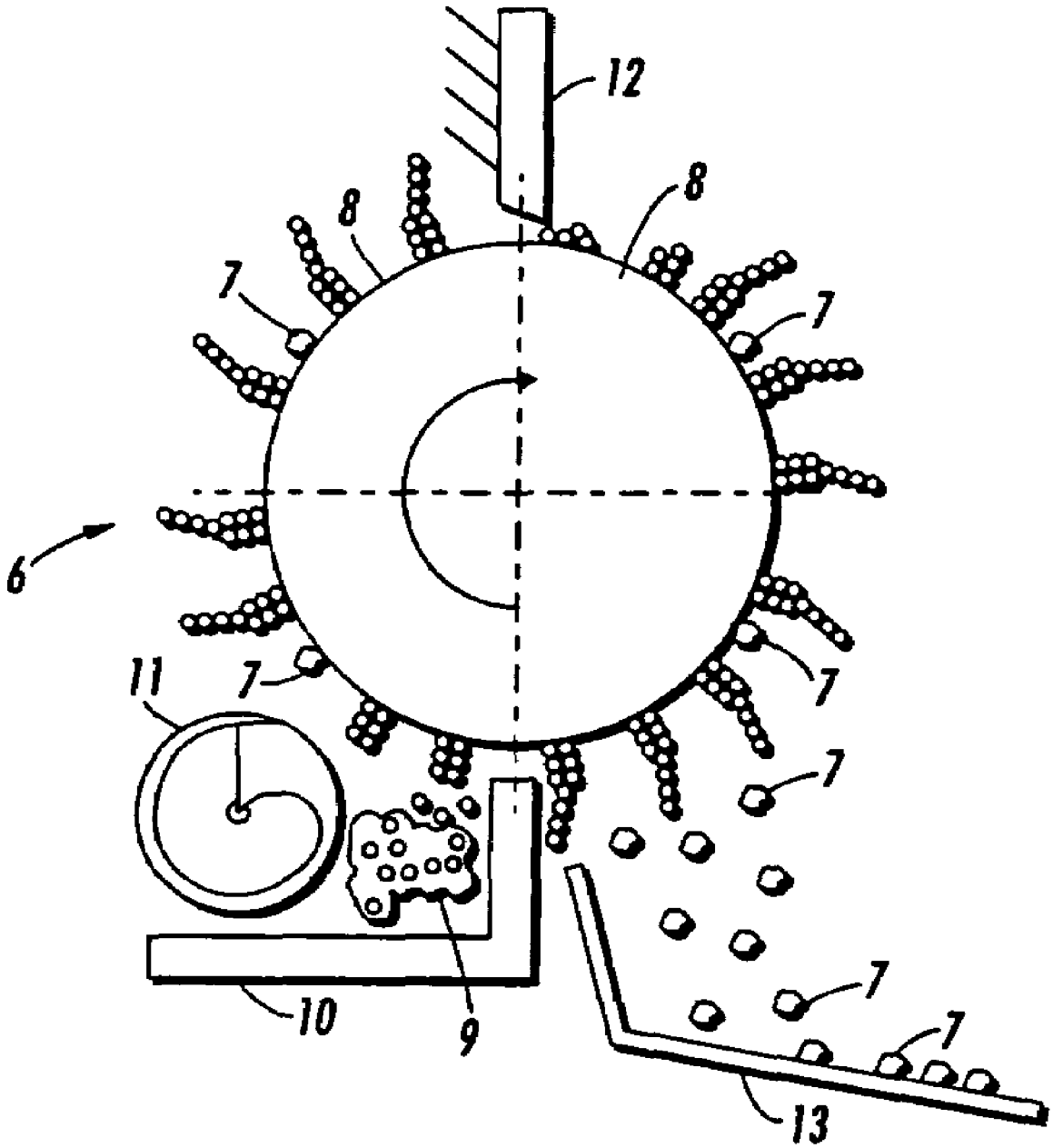
FIG. 2 illustrates an automated method involving a magnetic roll device.

In FIG. 2, a side view of an automated device 6 is shown. In device 6, a powered magnetic roll 8 is supported by bearings. The roll 8 rotates from 1 to 500 RPM primarily in one direction. It may be reversed for cleaning or better expulsion of "bad" particles 7. A measure mixture 9 of carrier with the test sample of toner is placed in the housing 10. An auger 11 gently mixes the two components to create a homogeneous mixture. The auger distributes the mixture 9 along the axis of the magnetic roll 8. The auger 11 may or may not be geared to the magnetic roll to move dependently. The roll 8 rotates moving the mixture 9 under the trimmer bar 12. Particles bigger than the trimmer bar-roll gap are caught behind the trimmer bar. This manifests itself by disturbing the uniform magnetic-brush pattern. The toner contaminant particles (coarse particles or agglomerates) 7 are captured in tray 13 as they are expelled from the roll. Since the pull of gravity is greater than the magnetic attraction of contaminants 7 to roll 8, they will fall into collection tray 13. The particles are captured and analyzed using the typical analysis methods. The test analysis can then be used when setting up a toner manufacturing system. When used as a purification method, the carrier-toner mixture is removed from the developer housing and reclaimed for future use. Because the impurities are much less attracted to magnetic carrier they will be free to distance themselves from the carrier mixture, thereby the good toner-carrier will be closer to the magnet and the bad material will be farther from the magnet or magnetic pull.

For improved visual contrast, used carrier may be reused with alternating toner colors. Black toner can be tested with any other color. FIG. 2 shows the device 6 and how the soft agglomerated particles 7 are separated by this process. These particles readily break up by the conventional screening methods. In one embodiment, visual analysis is all that is required to grade the quality of the toner sample at this point. These particles 7 thereby are readily separated by this method. The agglomerates or contaminants 7, because they are less attracted to magnetic roll 8 than are the developer mix 9, will fall from roll 8 while the developer 9 will readily adhere to roll 8 to be reclaimed. This embodiment of the invention is a novel automated process delivered in a device 6 that detects the type of very soft toner agglomerates 7 that cause the print defects. The device 6 uses carrier that is mixed with the test toner material 9 in a modified developer system in order to visually detect the out-of-specification particles 7. The device 6 which may be a stand-alone device which works by attracting and holding the correct size developer particles similarly to the process that occurs in the development housing. The problematic larger particles 7, be they soft agglomerated toner or additive, coarse particles or foreign particles are less able to be electrically attracted by the carrier but are captured by the magnetic brush action of the magnetic roller 8. The bad particles that are small enough to pass under the trimmer bar 12 are carried around with the rotation of the roll. The weakly-held agglomerates 7 particles then fall from the roll due to gravity or centrifugal force and are collected in a tray 13 or on a sheet of paper. An inspection, including a visual inspection and analysis of the "bad" material can then proceed.

The reservoir or device 6 includes augers indicated at 11 which are rotatably mounted in the reservoir chamber. Augers 1 serve to transport and to agitate the material 9 within the reservoir 10 and encourage the toner particles to charge and adhere triboelectrically to the carrier granules. Magnetic brush roll 8 transports developer material 9 from the reservoir 10. Magnetic brush rolls 8 are well known so the construction of roll 8 need not be described in great detail. Briefly, the roll comprises a rotatable tubular housing within which is located a stationary magnetic cylinder having a plurality of magnetic poles impressed around its surface. The carrier granules of the developer material are magnetic and, as the tubular housing of the roll 8 rotates, the granules (with toner particles adhering triboelectrically thereto) are attracted to the roll 8. Metering blade 12 removes excess developer material from the magnetic brush roll and ensures an even depth of coverage with developer material.

Figure 3:
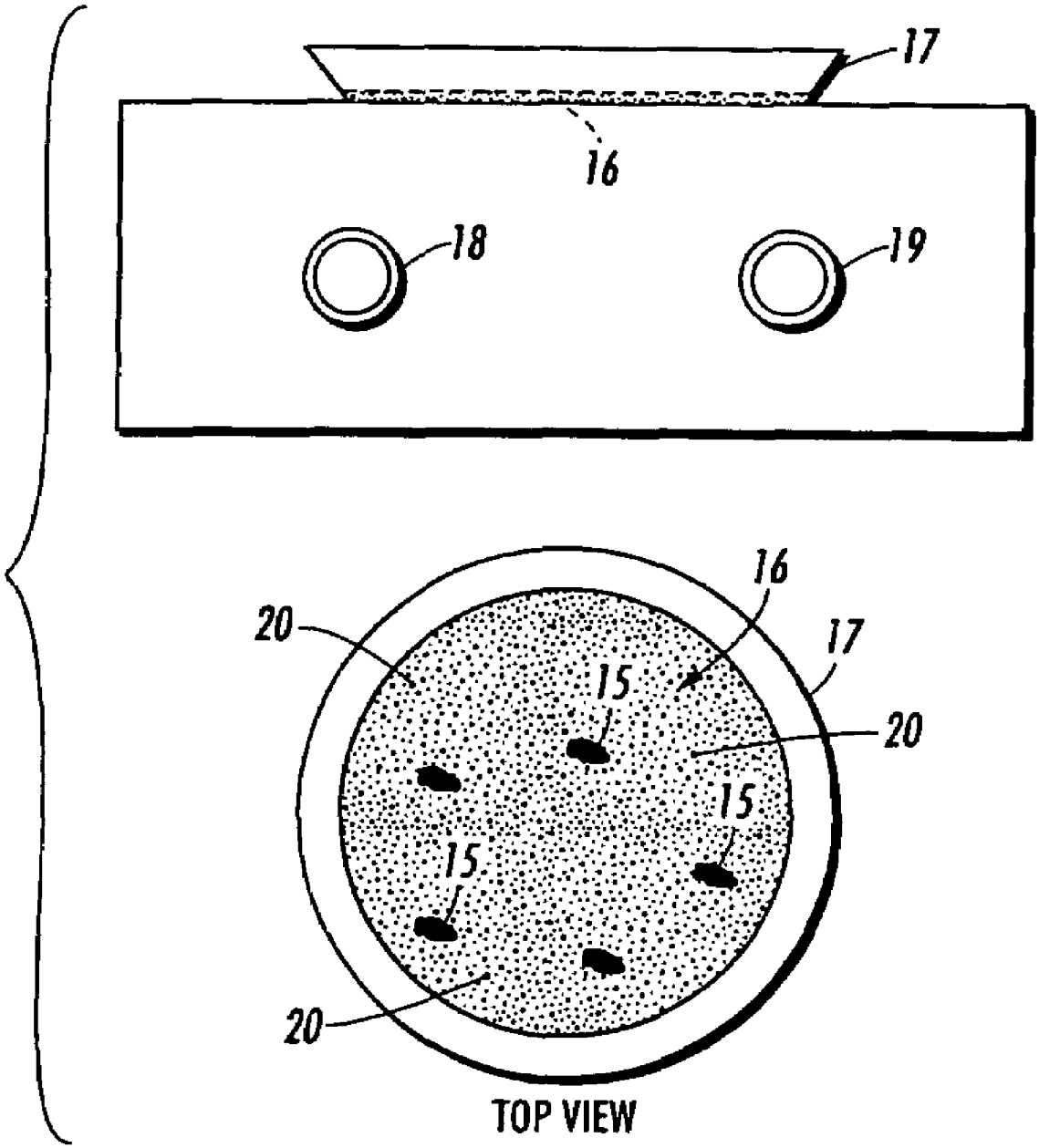
FIG. 3 illustrates a known magnetic stirrer conventionally used to mix liquids.

In FIG. 3, a magnetic stirrer 14 was used to separate impurities 15 from the developer mix 16. Any suitable magnetic stirrer 14 such as Corning Hot Plate Stirrer PC-351 may be used. A measured amount of magnetic developer 16 (containing impurities) are deposited in a flat disk 17. Speed knob 18 is turned to effect a proper stirring or mixing. Once the mixing occurs, impurities 15 are visually apparent in the mix 16. The mixture 20 is then easily removed leaving the impurities or agglomerates 15 which, if desired, may be fused by the use of heater knob 19 and then removed from the disk. The top view of FIG. 3 shows how visible impurities 15 are after purification treatment. Also shown in the top view are smaller purified developer particles 20.

In summary, embodiments of this invention disclose a method that can be used as either or both a test to determine the presence and kind of toner-magnetic developer impurities or that can be used to remove contaminants and impurities from a toner or magnetic developer mix. These contaminants can be toner-related contaminants or can be toner additive-related contaminants.

When used as a method of removing contaminants from a toner and developer to be used in a magnetic brush development system, this method comprises the steps of mixing the toner with magnetic carrier to form thereby a homogeneous developer mixture. This mixture contains toner and developer contaminants. A magnet is placed in magnet-attracting distance from the mixture to cause thereby the developer to be attracted toward the magnet and the contaminants to be less attracted. This thereby causes separation of the contaminants from the developer. The developer is thus separated from the contaminants leaving a substantially pure developer mixture. The toner has tribo properties that permit it to more readily be attracted to the carrier than the contaminants.

When the present embodiments are used as a test procedure for detecting contaminants in toner that can cause print defects when used in an electrostatic marking system, the procedure is generally as follows. The procedure comprises the steps of mixing in a container a test toner with a measured amount of magnet carrier. This mix of carrier and toner is gently tumbled in the container to create a homogeneous mixture comprising a magnetic developer of toner-covered carrier particles. A magnet is placed in a magnetic-attracting distance from the mixture to cause the magnetic developer to be attracted toward the magnet and the contaminants to be less attracted. The contaminants will appear and are easily separated out leaving a remaining purified developer mixture. The mixing can use a magnet or other suitable means to agitate the mixture. The contaminants are not able to be captured or attracted by the carrier and thus float in the mixture so as to be easily magnetically separated and removed therefrom. When the mixture is gently vibrated in a horizontal direction, the toner-covered carrier particles settle toward the magnet and the contaminants separate to a top surface of the mixture. An appearance of the contaminants is verified, in some cases, by visual inspection. This testing procedure is ideally used prior to beginning toner manufacturing production using the contaminant information obtained from the test procedure.

In a specific method of removing contaminants from an impure toner or developer, the method comprises the steps of mixing predetermined amounts of the toner with a predetermined amount of magnetic carrier to form thereby a homogeneous developer mixture containing developer and the contaminants. The toner has tribo properties that allow toner particles to be more readily than the contaminants to be attracted to the magnetic carrier. A magnet is placed in a magnetic attraction distance from the mixture to cause a magnetic force to be exerted on the mixture and cause the magnetic developer to be attracted toward the magnet and the contaminants to be less attracted to the magnet. This isolates the contaminants from the developer and the two are easily separated. In this method, the mixing is conducted by a method selected from the group consisting of manual mixing, automated mixing, non-magnetic mixing, magnetic mixing and mixtures thereof.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of removing contaminants from a toner and developer to be used in a magnetic brush development system, said method comprising the steps of mixing said toner with magnetic carrier to form thereby a homogeneous developer mixture, said toner and developer containing said contaminants, placing a magnet in magnet-attracting distance from said mixture to cause thereby said developer to be attracted toward said magnet and said contaminants to be less attracted, thereby causing separation of said contaminants from said developer and separating out said contaminants leaving a substantially pure developer mixture.

2. The method of claim 1 wherein said contaminants comprise both toner and toner additive contaminants.

3. The method of claim 1 wherein said steps can be used as a test method for detecting the amount and type of contaminants in toner and developer that may cause print defects.

4. The method of claim 1 wherein said toner has tribo properties that permit it to more readily be attracted to said carrier than said contaminants.

5. The method of claim 1 wherein said steps comprise a simulation of a mixing and rejection of contaminants in developers that occur in an actual electrostatic development system.

6. The method of claim 1 wherein there is substantially no adverse degradation of said mixture after said contaminants are removed.

7. The method of claim 1 wherein said substantially pure developer mixture is enabled to provide less print defects when used in an electrostatic marking system.

8. A test procedure for detecting contaminants in toner that can cause print defects when used in an electrostatic marking system, said procedure comprising the steps of mixing in a container a test toner with a measured amount of magnetic carrier, gently tumbling said carrier and toner in said container to create a homogeneous mixture comprising a magnetic developer of toner-covered carrier particles, placing a magnet in a magnetic-attracting distance from said mixture to cause said magnetic developer to be attracted toward said magnet and said contaminants to be less attracted until said contaminants appear and separating out said contaminants from a remaining purified developer mixture.

9. The procedure of claim 8 whereby said mixing uses a magnet to agitate said mixture.

10. The procedure of claim 8 whereby said contaminants are not able to be captured by said carrier and thus float in said mixture so as to be easily magnetically separated and removed therefrom.

11. The procedure of claim 8 whereby said mixture is gently vibrated in a horizontal direction whereby said toner covered carrier particles settle toward said magnet and said contaminants separate to a top surface of said mixture.

12. The procedure of claim 8 whereby an appearance of said contaminants is verified by visual inspection.

13. The procedure of claim 8 whereby said mixing is conducted using a magnet to agitate said mixture.

14. The procedure of claim 8 whereby said contaminants comprise impurities of said toner and of at least one additive.

15. The procedure of claim 8 as used prior to beginning toner manufacturing production using contaminant information obtained from said test procedure.

16. A method of removing contaminants from an impure toner or developer, said method comprising the steps of mixing predetermined amounts of said toner with a magnetic carrier to form thereby a homogeneous developer mixture containing developer and said contaminants, said toner having tribo properties that allow toner particles to be more readily than said contaminants to be attracted to said carrier, placing a magnet in a magnetic attraction distance from said mixture to cause a magnetic force to be exerted on said mixture and cause said magnetic developer to be attracted toward said magnet and said contaminants to be less attracted to said magnet and thereby separating said contaminants from said developer.

17. The method of claim 16 wherein said contaminants comprise both toner and additive impurities.

18. The method of claim 16 wherein said steps simulate the rejection of print defect causing contaminants that occur in an electrostatic printing process.

19. The method of claim 16 where said mixing is conducted using magnetic mixing.

20. The method of claim 16 where said mixing is conducted by a method selected from the group consisting of manual mixing, automated mixing non-magnetic mixing, magnetic mixing, and mixtures thereof.

* * * * *